US005522678A

United States Patent [19]

Marshall et al.

[11] Patent Number: 5,522,678

[45] Date of Patent: Jun. 4, 1996

[54] GROUND ANCHORS

[75] Inventors: George P. Marshall, Bolton; Charles J. Ashdown, Bwlch, both of United Kingdom

[73] Assignee: Kelley Company, Inc., Milwaukee, Wis.

[21] Appl. No.: 228,814

[22] Filed: Apr. 18, 1994

[51] Int. Cl.[6] ..... E02D 17/08; F16L 55/165

[52] U.S. Cl. ..... 405/184; 405/272; 405/282

[58] Field of Search ..... 405/154, 184, 405/272, 274, 282; 138/98; 403/41, 49, 384, 386, 400

[56] References Cited

U.S. PATENT DOCUMENTS 3,866,425 2/1975 Morrice ..... 405/274
4,059,964 11/1977 Pavese .
4,777,984 10/1988 Storah ..... 138/98

FOREIGN PATENT DOCUMENTS 0075453 9/1982 European Pat. Off. .
1561101 2/1980 United Kingdom .
2261687 11/1991 United Kingdom .

*Primary Examiner*—Ramon S. Britts
*Assistant Examiner*—Frederick L. Lagman
*Attorney, Agent, or Firm*—Michael, Best & Friedrich

[57] ABSTRACT

Apparatus and method of forming a ground anchor to spread evenly the loads produced during, for example, pipe lining. The ground anchors comprise a frame and means for clamping the frame to upper ends of a series of ground engaging piles such that the frame and piles define a substantially rigid assembly. The frame may comprise first and second frame portions through which the piles may be driven, the frame portions being held in spaced apart relationship during pile driving by temporary coupling means.

11 Claims, 11 Drawing Sheets

GROUND ANCHORS

BACKGROUND OF THE INVENTION

1. Field of the Invention

This invention relates to ground anchors, and particularly to a method and apparatus which can be used to withstand high forces that arise when relining pipes.

2. Description of Prior Art

Underground pipelines for the transport of fluids or gases can become damaged, worn or corroded during use. It is thus desirable to be able to provide a lining to the pipe to strengthen it and to prevent leakage from the pipe.

One method of pipe lining is to pull a plastics liner pipe through an installed pipe. This is done by drawing the liner pipe into the installed pipe through a die to reduce its diameter from greater than to less than the installed pipe diameter. Tension is maintained until the liner pipe is correctly located within the installed pipe. Tension is then released and the liner pipe expands to form a close-fitting lining. Such lining may be performed for long lengths of pipe, for example hundreds of meters, but the forces exerted on the die and on a winch used for pulling the liner through the installed pipe can be very large indeed, for example 50 tonnes. It is therefore necessary to provide ground anchors to withstand these forces.

The ground anchors used have generally been large concrete blocks placed on or embedded in the ground adjacent excavated ends of the installed pipe. These blocks must be massive to provide the required anchorage, which is inconvenient both with regard to the required space and the time and effort necessary to place the anchors in position.

The excavations which are dug to provide access to the installed pipe are conventionally lined with piles driven into the ground to prevent the walls of the excavations collapsing. Such piles are however not connected to the conventional ground anchors.

Frame structures to support sheet piling have been disclosed in U.S. Pat. No. 4,059,964 (Pavese), GB 1, 561, 101 (Hudswell Morrice) and EP-A- 0075453 (Hudswell Morrice). These prior art frames do assist in the insertion and withdrawal of piles but have not been used as ground anchors.

SUMMARY OF THE INVENTION

It is an object of the present invention to obviate or mitigate the aforementioned disadvantages. It is also an object of the present invention to provide a method and apparatus for forming ground anchors to enable a liner pipe to be pulled through an installed pipe.

It is a further object of the invention to provide a method for lining an installed pipe in which piles used to shore up the sides of excavations dug to give access to the installed pipe are incorporated in ground anchors that support components of the pipe lining apparatus.

According to the present invention there is provided an apparatus for forming a ground anchor, comprising a frame and means for clamping the frame to a series of ground engaging piles such that the frame and piles define a substantially rigid assembly.

The invention also provides a method for forming a ground anchor, wherein a series of piles are driven into the ground, and upper ends of the piles are clamped to a frame to define a substantially rigid assembly.

Clamping the frame to the piles ensures that loads may be transferred through the frame and the piles to the ground. Thus an effective ground anchor can be provided using piles which are often required in any event to prevent the walls of an excavated chamber from collapsing.

BRIEF DESCRIPTION OF DRAWINGS

A specific embodiment of the present invention will now be described by way of example, with reference to the accompanying drawings, in which.

DESCRIPTION OF THE PREFERRED EMBODIMENT OF THE INVENTION

Figure 1:
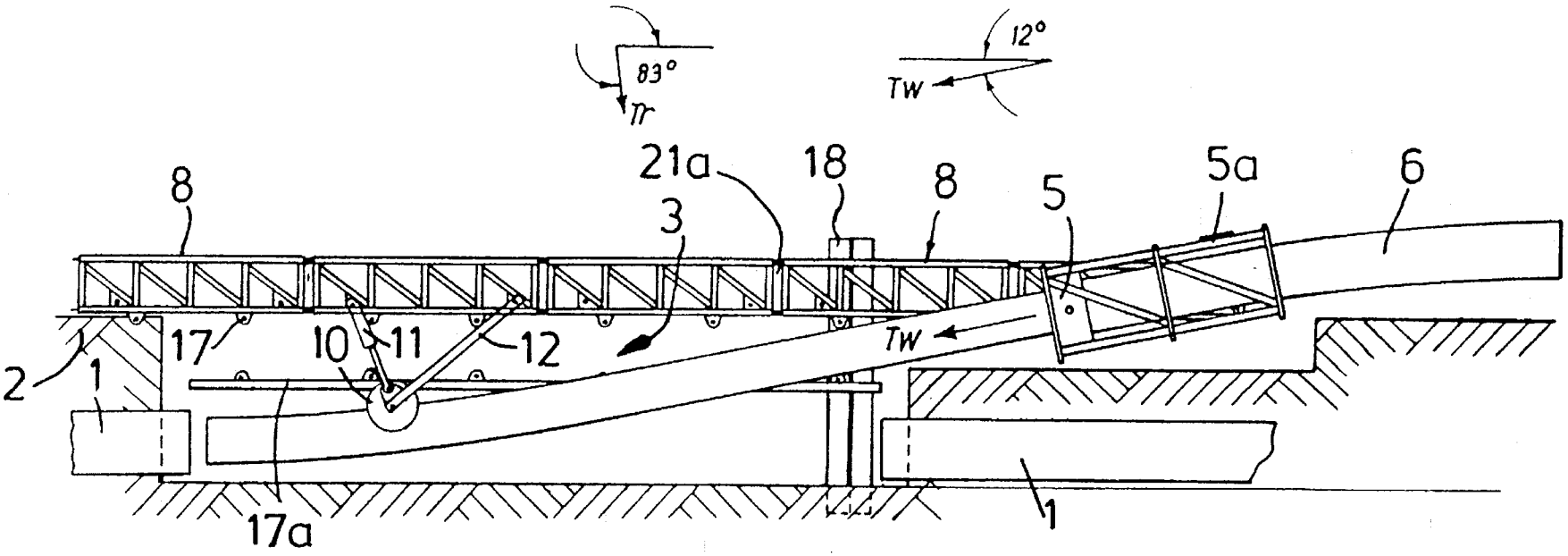
FIG. 1 is a side view of a part of a pipe lining apparatus embodying the present invention.
Figure 2:
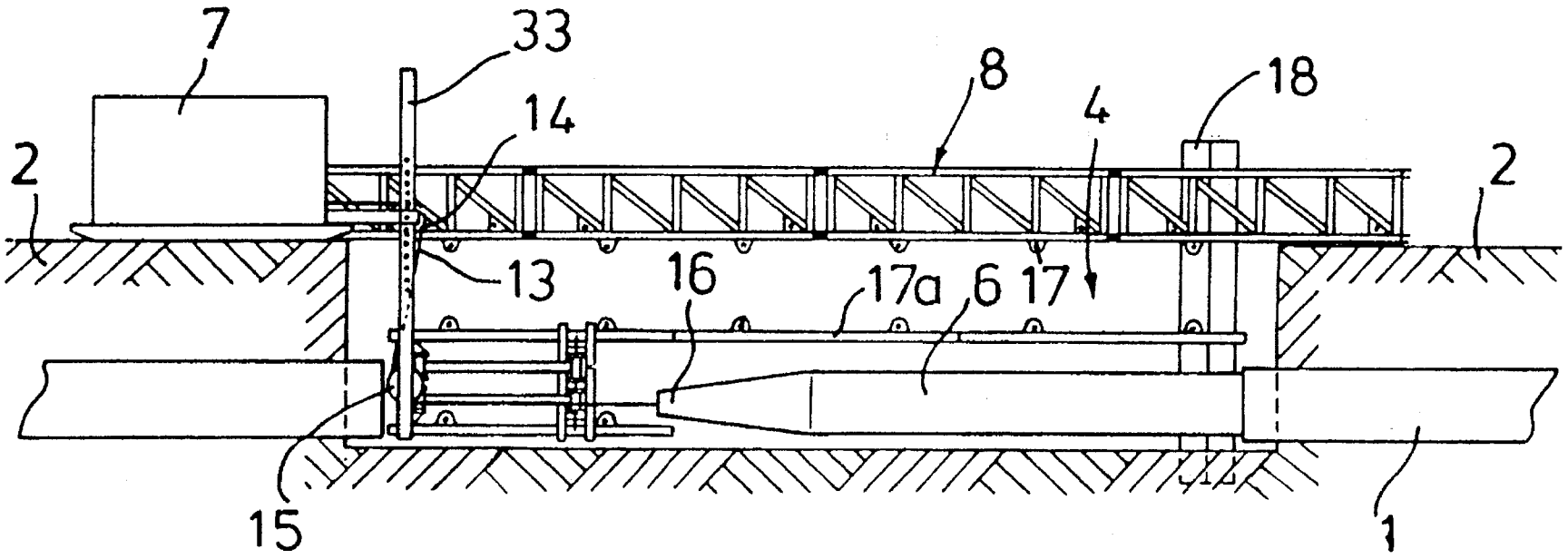
FIG. 2 is a side view of another part of the pipe lining apparatus of FIG. 1.

Referring to the drawings, an installed pipe 1 which is to be lined is buried in the ground 2. The known technique of lining such a pipe is to dig chambers 3, 4 at each end of the pipe. The chambers 3 and 4 may be hundreds of meters apart. A die 5 is mounted in the chamber 3 and a liner pipe 6 is pulled through the die and through the pipe 1 using a winch 7 mounted adjacent the chamber 4. Once the liner pipe 6 has been fully pulled through the pipe 1, the tension in the pipe 6 is released and it recovers in diameter to engage firmly the inner surface of the buried pipe 1.

The apparatus as shown in the attached drawings is suitable for use in such pipe lining. It will be appreciated that the tension applied to the liner pipe 6 exerts large forces on the die 5 and the winch 7 and these forces must be resisted. In the illustrated apparatus this is achieved by providing frame structures adjacent chambers 3 and 4 and mounting the die 5 and winch 7 on these structures. Each frame structure comprises inner frame portions 8 and outer frame portions 9. The frame portions 8 and 9 are clamped onto piles which are used to support the ground 2 adjacent the chambers 3 and 4.

Figure 10:
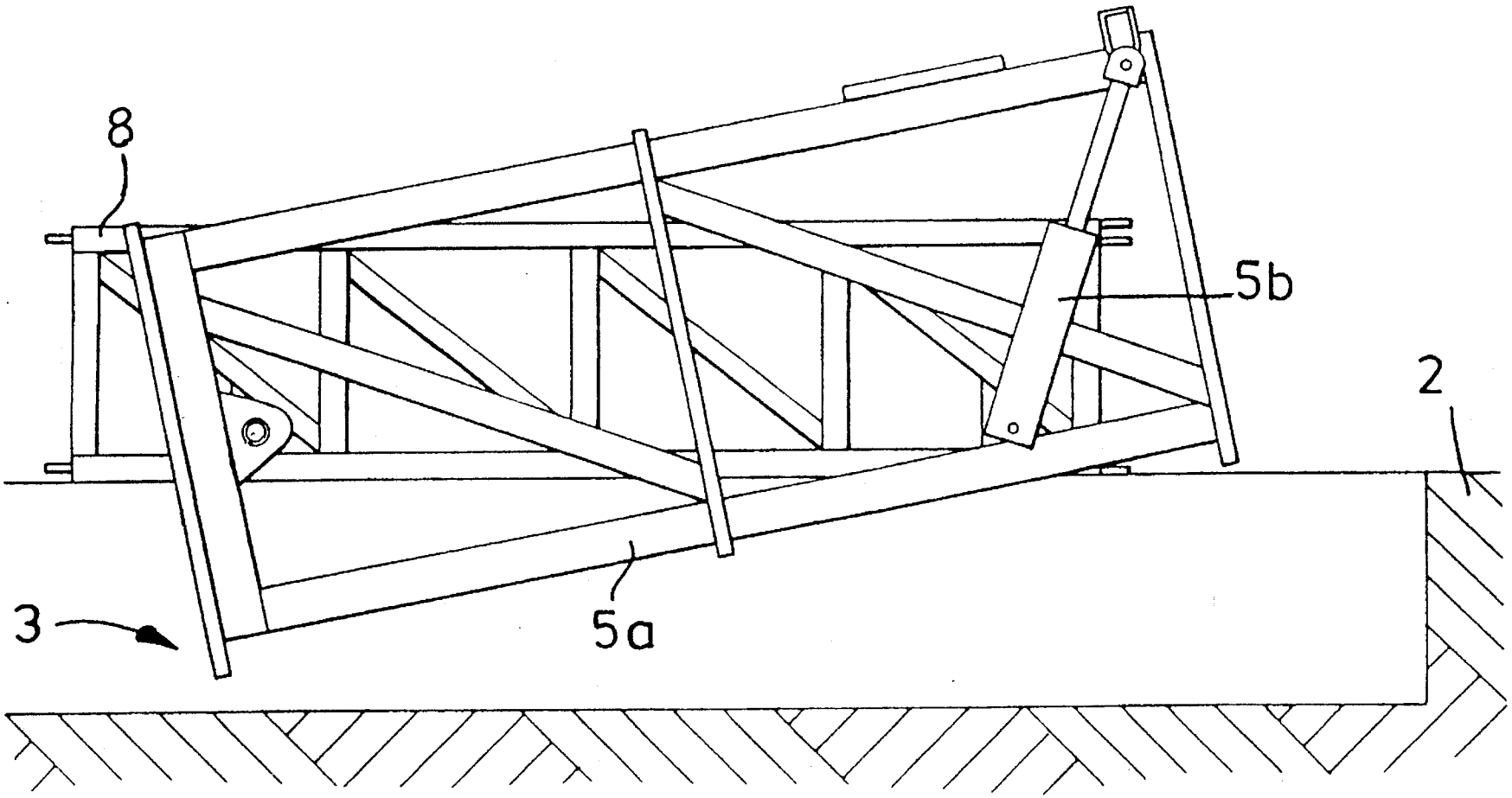
FIG. 10 is a side view of a die frame shown in FIG. 1.
Figure 11:
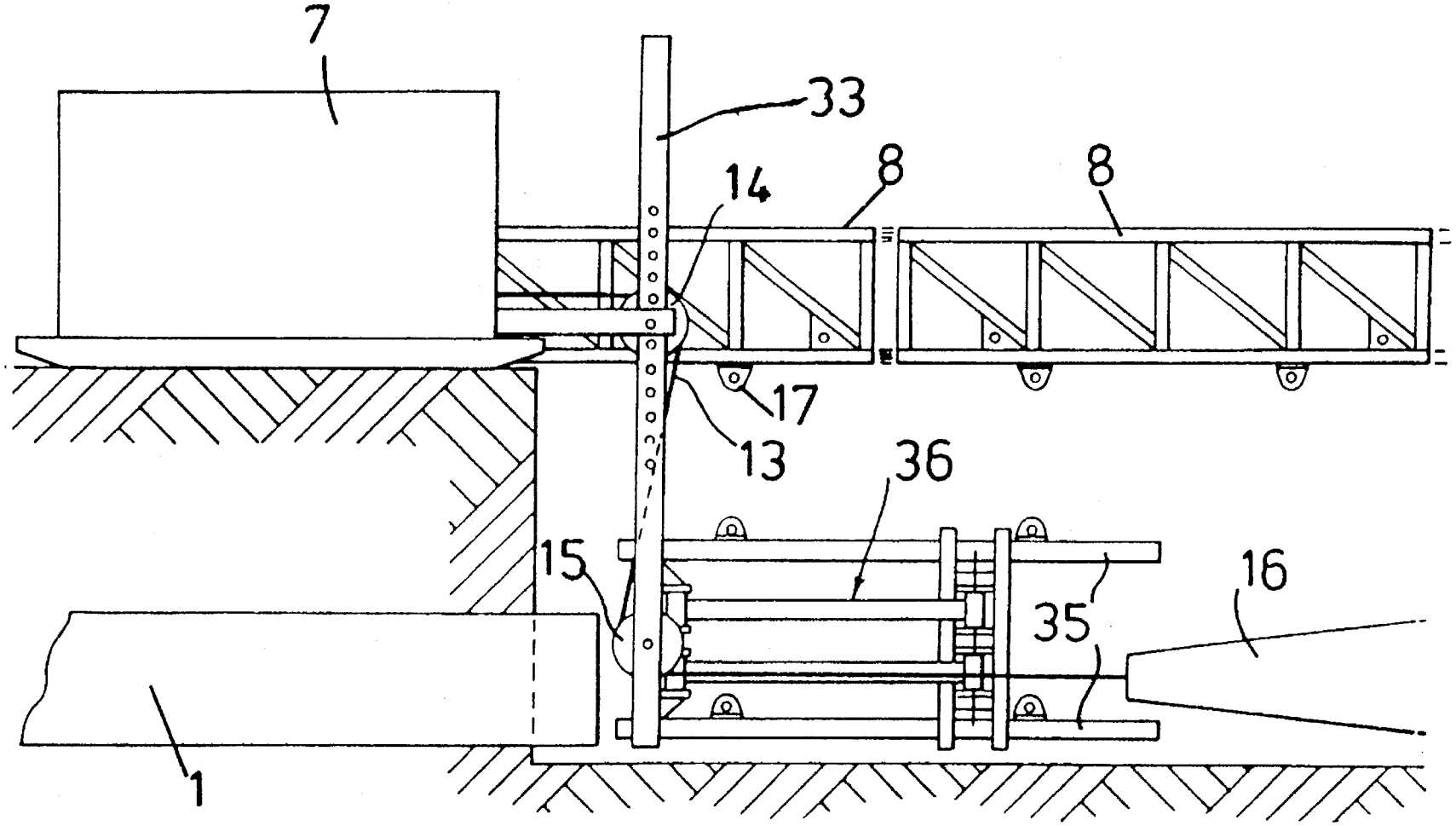
FIG. 11 is an enlarged view of a winch of FIG. 2.

The die 5 is supported on a sub-frame 5*a* (FIG. 10) which is pivotally mounted on the frame structure and can be pivoted by a jack 5*b* to a desired position. A guide roller 10 is also supported on the frame structure, the roller serving to ensure that the liner pipe 6 is directed centrally into the installed pipe 1. Roller 10 is mounted on jack 11 and pivot arm 12, the jack 11 being operated manually to correctly position the roller 10. Die 5 is positioned as shown well above the level of the installed pipe 1 to reduce the size of the chamber 3 at the end of the pipe 1. The force exerted on the roller is represented in FIG. 1 by vector Tr and the force exerted by the winch is represented in FIG. 1 by vector Tw.

The chamber 3 may be stepped as shown in FIG. 1. As shown in FIG. 1, the bending radius of the liner pipe 6 is approximately 40 times the liner pipe diameter. The vertical height of the die frame is selected to maintain the liner pipe 6 close to the surface of the ground for ease of handling and safety.

The winch 7 is mounted on the frame structure provided at the chamber 4. The winch is connected to a winch cable 13, which is used to draw the liner pipe 6 through installed pipe 1. Cable 13 extends around rollers 14, 15 which are located in the chamber 4 so that the winch 7 may be positioned above ground. The winch cable 13 is connected to the liner pipe 6 by means of a tapering nose assembly 16.

Figure 8:
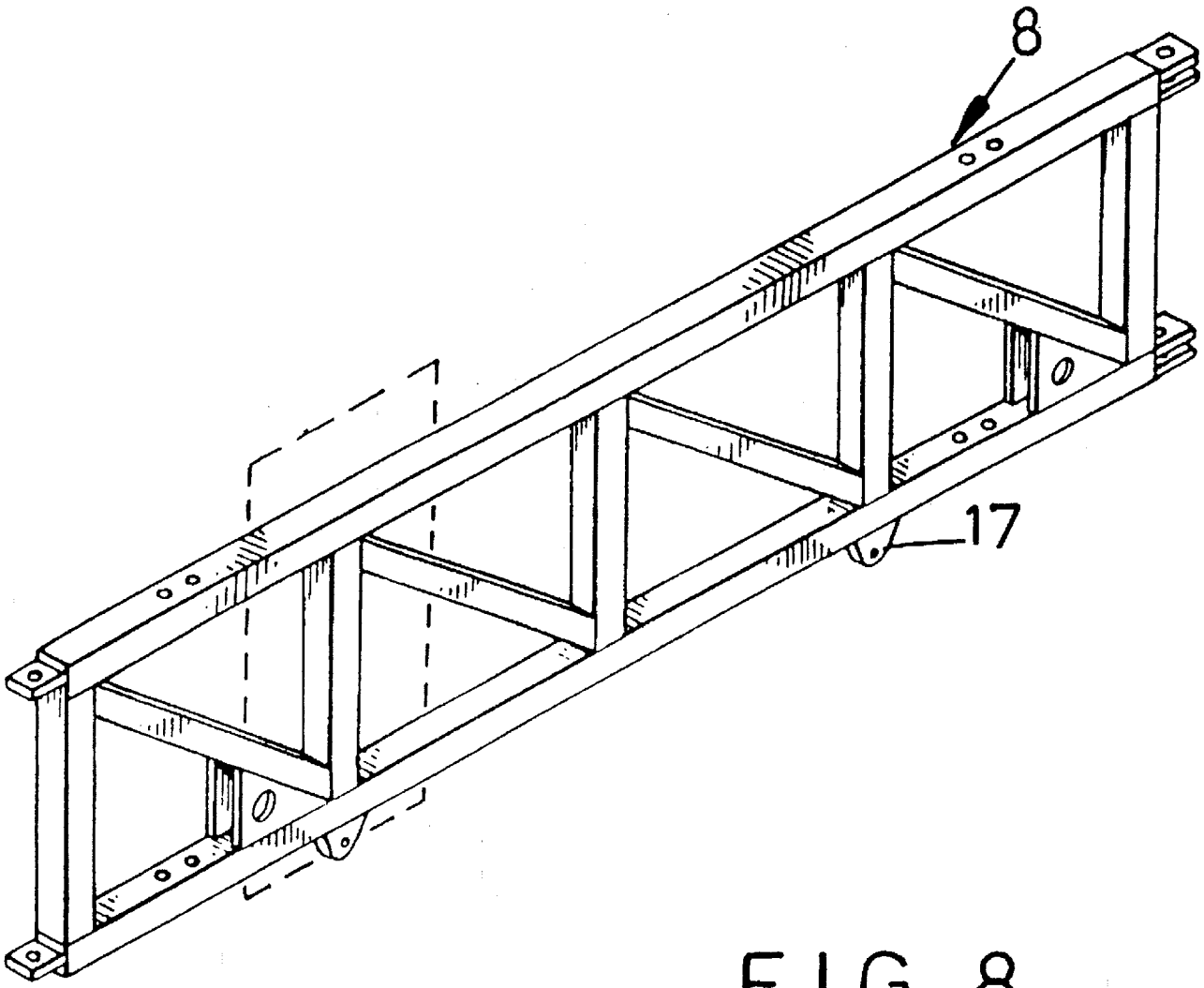
FIG. 8 is a view of an inner pile frame section.

The frame portions 8 and 9 are described below. Each frame shown is 4 m long and is of a fully welded lattice construction, but alternative types of construction may be used. The inner frames 8 are simply rectangular upright frames, whilst outer frames 9 comprise two rectangular frames connected at right angles and braced by struts. Each frame portion 8 is provided with attachment points 17 (FIG. 8) to enable walings 17*a* a to be supported from the frame.

Piles 18 are driven into the ground to support the sides of the chambers 3 and 4 and to spread forces applied to the framework to the ground. The piles 18 are driven into the ground between the inner and outer frame portions 8, 9, which as described below also serve to guide the piles into place. Two different types of pile are used which interlock together, that is sheet piles 18*a* and box piles 18*b* which are formed of two sheet piles welded together.

Walings 17*a* are provided along the walls of the trench, and have hydraulic waling jack struts 17*b* as required. The walings 17*a* are capable of supporting the piles over at least 6 meter lengths without strutting. The positioning of the strutting is flexible so that individual struts can be placed wherever necessary to suit the position of the liner pipe.

Figure 5:
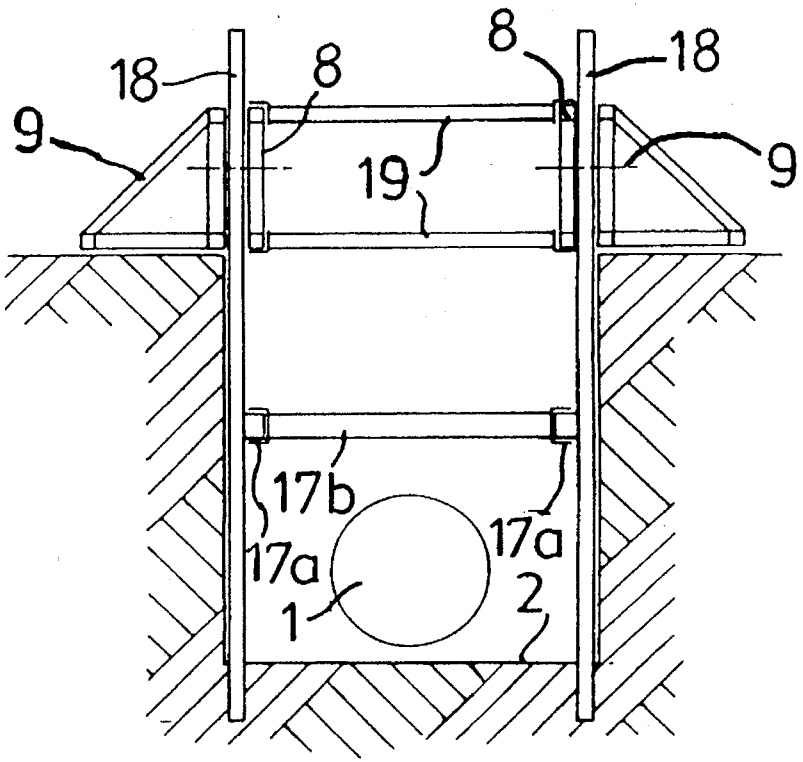
FIG. 5 illustrates the disposition of a frame shown in FIG. 1 relative to an excavation dug to provide access to the installed pipe to be lined.
Figure 7:
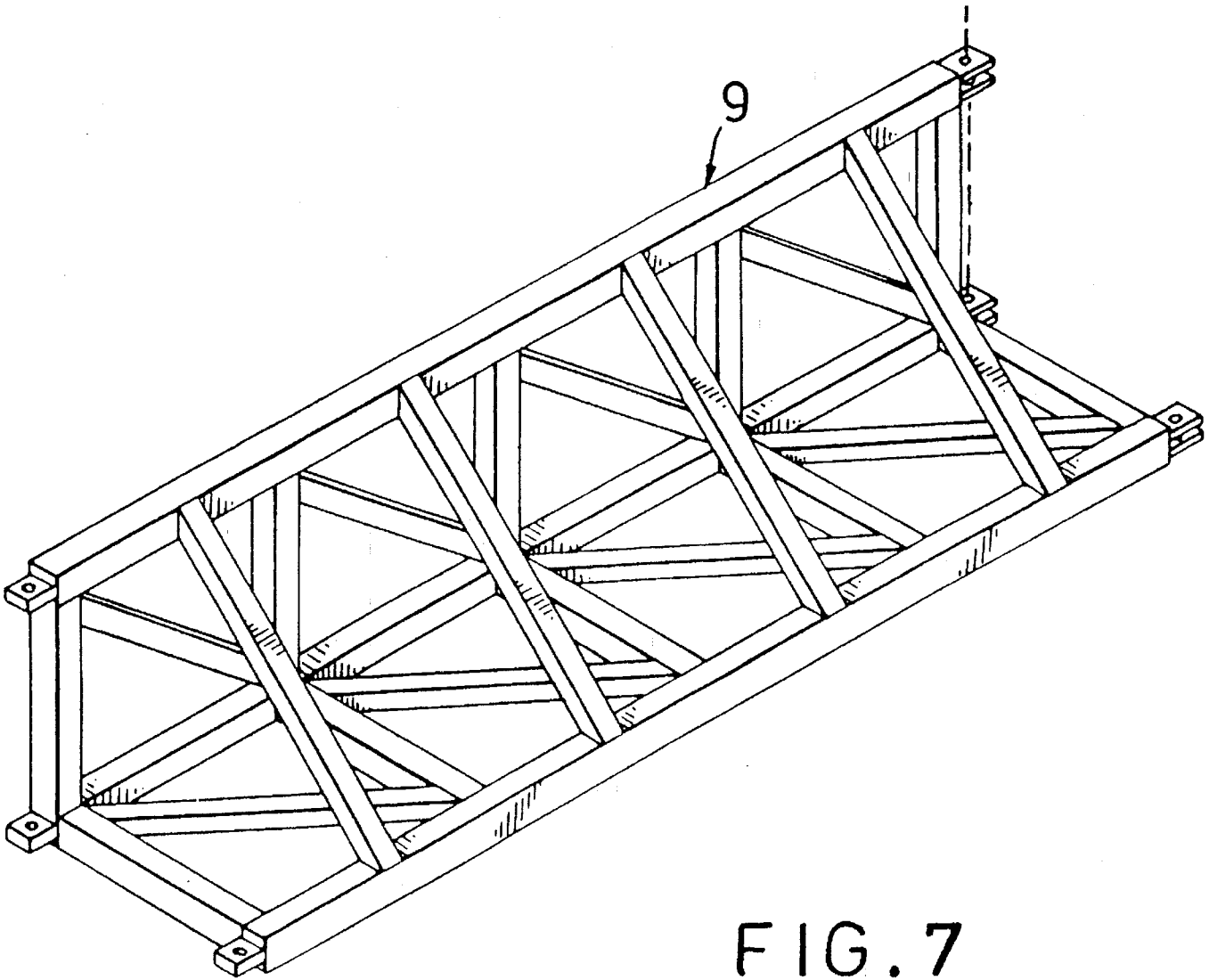
FIG. 7 is a view of an outer pile frame section.

FIG. 5 shows a typical cross section through the excavation indicating e.g. a 2 meter clearance between walings 17 *a* for equipment access, and also shows the piles toed in below the base of the trench.

The piling frame assembly is designed so that it cannot be assembled out of alignment, nor be pushed out of alignment by the forces encountered during pile driving. It is used in accordance with the following method:

The exact line of the installed pipe 1 is first determined so that the center line of the chambers 3,4 may be set out. In order to do this, a pilot excavation is carried out at one end of the workings. The pilot excavation is dug down to the level of the crown of the pipe and extended along the centre line of the pipe 1 until a pipe joint is reached. The excavation is then extended a further 500 mm to set out a 'far' end of chamber 3.

Another pilot excavation is made at the other end of chamber 3, and is dug some 12 meters back from the first pipe joint so that a second joint crown is exposed, with the excavation extended a further 500 mm to set out a 'near' end of chamber 3. In all, chamber 3 will thus be 13 m long.

Figure 9:
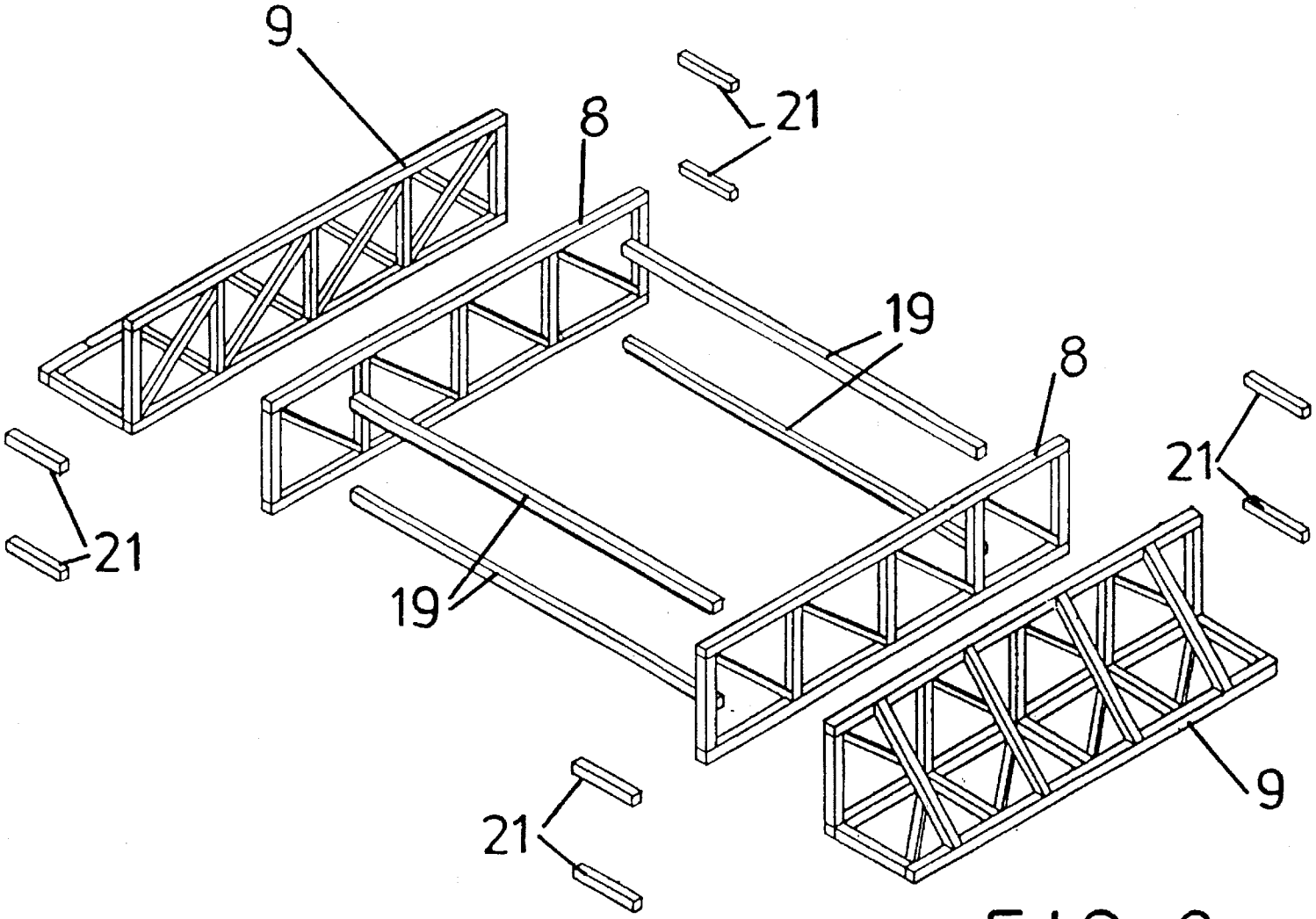
FIG. 9 is an exploded perspective view of inner and outer pile frames.

A first pair of inner piling frames 8 is set down at the pilot excavation at the 'far' end of chamber 3. Ends of the frames 8 are set down 1.5 meters beyond the end of the pilot excavation (i.e. 2 meters beyond the pipe joint). The frames are set in position symmetrically spaced about, and parallel with the center line of the pipe. Frames 8 are joined together using struts 19 (FIG. 9) at the top and bottom of the frames.

Figure 3:
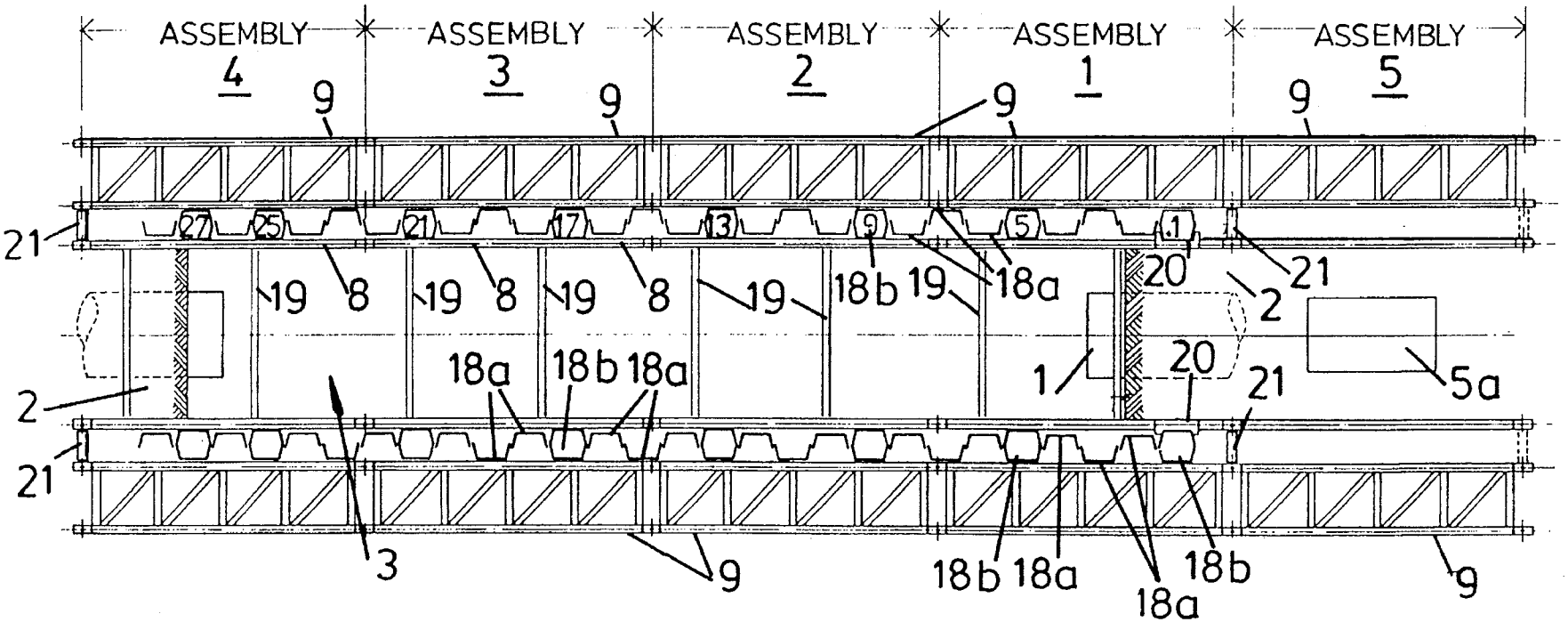
FIG. 3 is a plan view of the apparatus of FIG. 1.

Pile guide shoes 20 (FIG. 3) are bolted to one end of the inner frames 8, two shoes being attached at the top of each frame and two at the bottom. Outer frames 9 are then attached to the inner frames 8 using temporary couplers 21, with the shoes 20 projecting between the inner and outer frames. This forms a piling frame with a length of 4 m.

Box piles 18*b* (e.g. a Larssen Type 16W box pile) are then pitched between shoes 20 at position 1 on each side of the installed pipe. Driving of the piles is started, but not completed. Sheet piles 18*a* (e.g. Larssen type 16W) and further box piles are then pitched and driven into the ground, with box piles included at every fourth pile position along the entire length of the frame (i.e. at the 1st, 5th, 9th, etc positions). Driving of the box piles is completed at this stage. If the ground conditions so require, a further temporary guide frame may also be erected to guide the piles.

Figure 12:
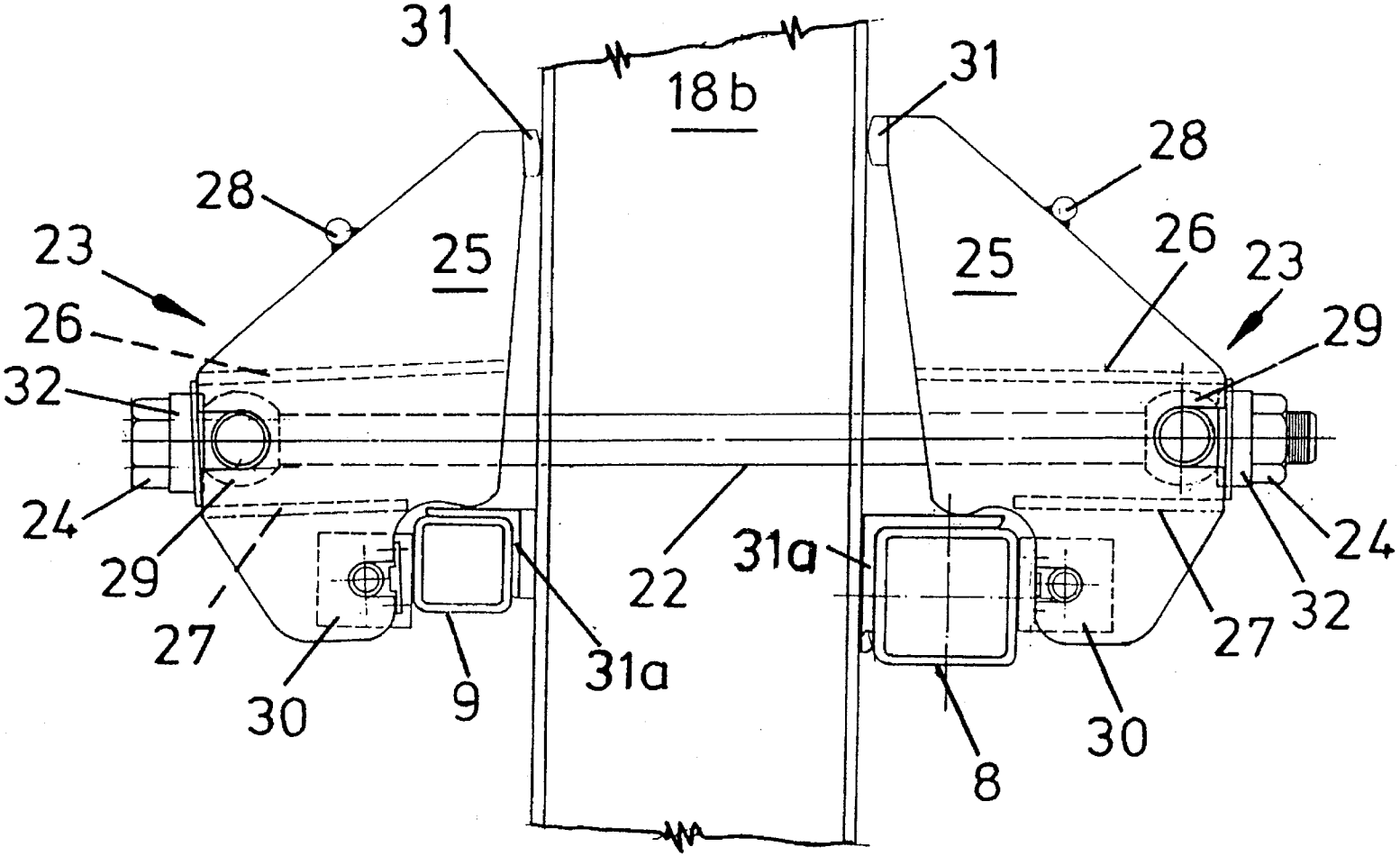
FIG. 12 is a vertical section through a box pile and clamp.

Holes are cut in the box piles 18*b* to suit tie bolts of 48 mm diameter. Bolts 22 are passed through the box piles and provided at each end with a clamp 23 (see FIG. 12). The clamps are secured to the bolts 22 by means of nuts 24 tightened to a torque of e.g. 3580 N-M to ensure the frame portions 8, 9 fully grip the box piles 18*b*.

Clamps 23 are each formed of two side plates 25 of generally triangular shape which are connected together by means of two strengthening plates 26, 27 extending horizontally between the side plates 25 and a rod 28 and anvil 31 welded to plates 25 near to the top edge of the clamps. Plates 26 and 27 define a space through which a bolt may extend. Also attached to side plates 25 between plates 26 and 27 is a bearing 29 which is rotatable with respect to plates 25. A further rotatable bearing 30 is also provided between plates 25 (below plates 26 and 27) to bear against either frame 8 or 9.

In use, a bolt 22 passes through bearings 29 and the box pile 18*b*, with one clamp 23 located on either side of the box pile. Washers 32 are passed onto the bolt 22 at each end thereof, with nut 24 following. The washers 32 bear against bearings 29.

As the clamps 23 are tightened against the frames 8 and 9 and the box pile 18*b*, the rotatable bearings 29, 30 ensure that the bolt 22 is not subjected to bending whilst the position of the main part of the clamps 23 is free to move as the nuts 24 are tightened. Anvils 31 bear against box pile 18*b*.

If necessary, angle iron sections 31*a* or solid metal packs (not shown) may be bolted to the frames 8,9 or inserted between the frames 8, 9 and the box pile to take up any tolerances, and to provide a good friction grip on the frames. Wooden folding wedges (not shown) are inserted between the faces of the sheet piles 18*a* and the bottom of the inner frames 8 before excavation proper is commenced.

Once the piles are in position, the struts 19 are temporarily removed and excavation is carried out to a depth required around the pipe. The struts 19 and additional struts 17*b* and walings 17*a* are installed as necessary as the chamber is formed, which begins at the far end of the frame and continues to within around 500 mm of the near end of the frame.

The temporary couplers 21 are then removed and the next pair of inner frames are coupled to the first pair by means of pins 21*a*. The sequence of operation as described above is then repeated, with the next pair of outer frames being coupled to the inner frames, and so on. The sequence is repeated so that four frame structures are in position, with the final sheet pile being placed at least one meter beyond the last exposed pipe joint.

A fifth frame assembly is then coupled to the first, at the far end of chamber 3. However, piles are not driven into the ground between the inner and outer frames of this fifth assembly. The excavation is extended between the frames a further 7 meters to a depth of 1 meter and a width of 2 meters to accommodate the die subframe 5*a* on its mountings (not shown).

At each end of the excavation, temporary support of the ground above the crown of the pipe is provided using close boarded timber or similar. The exposed pipe may then be cut out and removed, and the chamber bottom trimmed, with a sump dug at each end of the excavation for ground water pumping. Finally, the guide roller 10 is installed and the lining pipe positioned.

Excavation of chamber 4 for the winch apparatus is completed exactly as described above, except that the trench is not partially extended between the fifth frames.

The winch 7 is connected to a winch mast 33 having two main struts 34 extending at angles therefrom. The winch mast is lowered into the excavation on the center line of the installed pipe 1, and pinned into position.

Figure 4:
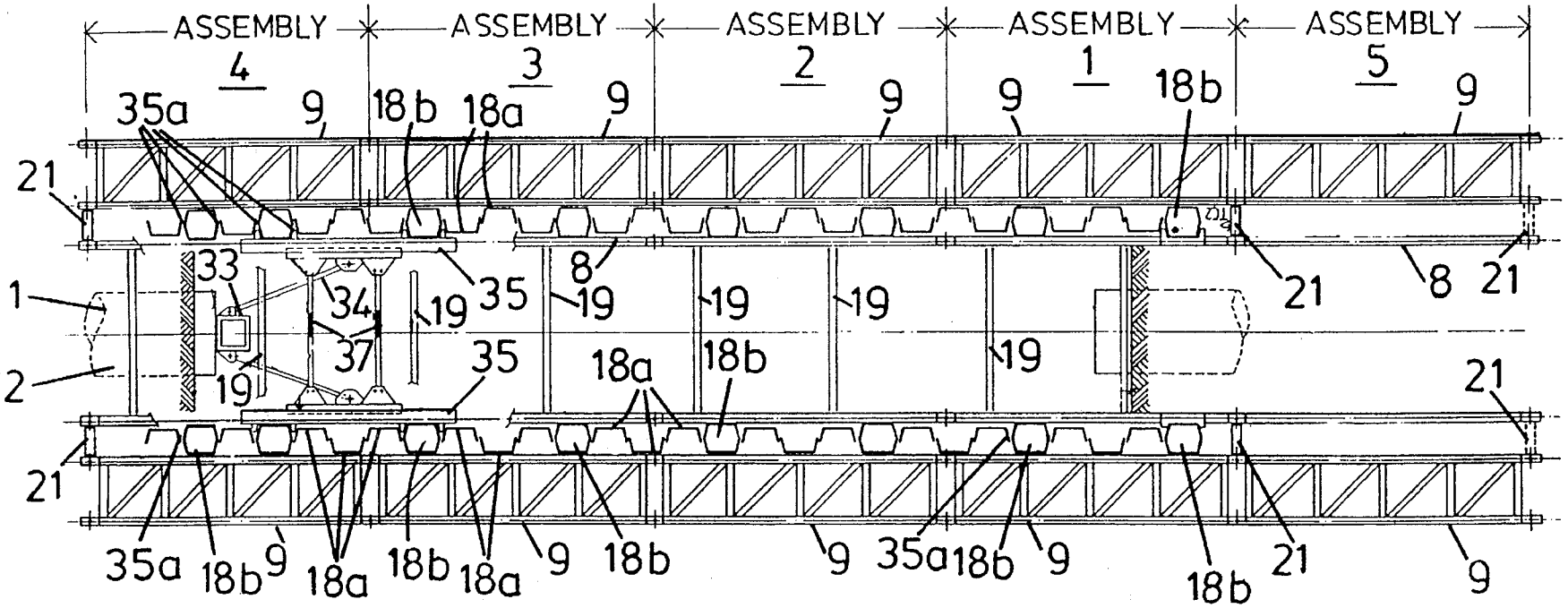
FIG. 4 is a plan view of the apparatus of FIG. 2.
Figure 6:
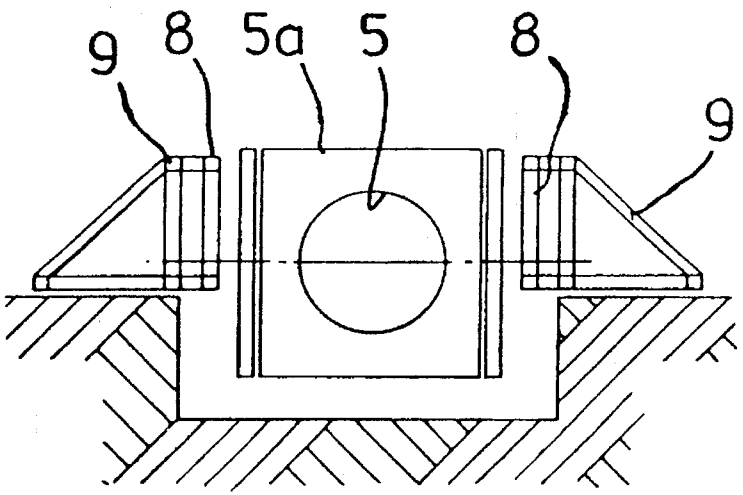
FIG. 6 illustrates the disposition of a die shown in FIG. 1.

As shown in FIG. 4, an upper profile carrier 35 is then lowered into the excavation and is hung against each side of the sheet piles from the inner frame 8 by chains (not shown) so that the struts 34 may reach the carrier. Carrier 35 is provided with projections 35*a* on the outer faces thereof to engage the piles. Two lower profile carriers are also inserted into the excavation, and are hung from the upper carriers.

A winch mast anchorage frame is erected at ground level, with two vertical side frames 36 having adjustable horizontal struts 37 pinned in position between them. The anchorage frame is then carefully lowered into excavation 4 between struts 19, and moved laterally so that pins in the upper and lower horizontal bars of the side frames 36 locate in slots provided in the upper and lower profile carriers 35. The side frames 36 are pushed apart, so that the pins provided thereon locate in the profile carriers 35. The adjustable struts 37 are tightened to hold the frame in position.

The main anchorage struts 34 are fitted to the bottom of the winch mast 33 and locate in sliding shoes provided on the side frames 36.

Once the apparatus is in place, winch 7 may be used to draw the liner pipe 6 through die 5 and installed pipe 1. After the pipe 1 has been lined, and the tension on the liner pipe has been released, the liner pipe expands in diameter into contact with the pipe 1 and contracts in length. The trench arrangements as described typically allow for some 14 meters of liner pipe for recovery. In some situations, however, this may not sufficient. To cater for this situation, the die frame may be moved back in 4 meter steps by simply adding further sections to the piling frame. To avoid having to extend the excavation, the die subframe may be raised clear of the ground and the final inner frames 8 placed the other way up to support the die subframe at the top thereof rather than at the bottom.

It should be apparent that changes may be made to the apparatus and method of use described, without departing from the scope of the invention. In particular, the dimensions given for the pipeline and excavations are merely exemplary. Accordingly, it is intended that all matter contained in the above description or shown in the accompanying drawings shall be interpreted as illustrative and not in a limiting sense.

What is claimed is:

1. A ground anchor for supporting forces with substantial horizontal components applied to equipment which is to be fixed in position relative to an excavation having walls, comprising:

a series of piles lining the walls of the excavation with bottom ends of said piles penetrating beneath the excavation;

a frame clamped to upper portions of said piles to define a substantially rigid pile and frame assembly; and means for mounting the equipment on the frame.

2. Apparatus as claimed in claim 1, wherein said frame comprises first and second frame portions, said piles being drivable into the ground between said first and second frame portions.

3. Apparatus as claimed in claim 2, further comprising coupling means to temporarily couple together said first and second frame portions in spaced apart relationship during pile driving.

4. Apparatus as claimed in claim 1, wherein said clamping means pass through apertures formed in at least one of said ground engaging piles.

5. Apparatus as claimed in claim 4, wherein said clamping means comprise a bolt to pass through said apertures in said pile, and a clamping portion positioned either side of said pile, said clamping portions each comprising at least one rotatable bearing to bear against said frame.

6. Apparatus as claimed in claim 4, wherein said piling comprises sheet piles and box piles, said clamping means passing through apertures formed in said box piles.

7. Apparatus for lining a pipe comprising:

a ground anchor comprising a frame and means for clamping the frame to upper ends of ground engaging piles such that the frame and plies together form a substantially rigid assembly;

a winch for drawing a plastics lining pipe through a pipe to be lined and positioned at one end of said pipe to be lined and supported by at least one of said frames; and a die positioned at another end of said pipe to be lined and supported by at least one of said frames, through which said plastics lining pipe may be drawn.

8. An apparatus as claimed in claim 7, wherein said die is pivotally interconnected with said frame.

9. An apparatus as claimed in claim 7, further comprising a guide roller supported on the frame and positioned to guide the lining pipe into the pipe to be lined.

10. A method for fixedly mounting equipment relative to an excavation, comprising the steps of:

driving a series of piles into the ground adjacent to the excavation site until the bottom ends of the piles penetrate the ground to a depth greater than the excavation depth;

excavating the ground such that the piles line the walls of the excavation;

clamping a frame to upper portions of the piles to define a substantially rigid pile and frame assembly; and mounting the equipment to the frame.

11. A method as claimed in claim 10, wherein the frame comprises first and second frame portions between which said piles are driven and which are temporarily coupled together during said pile driving.

* * * * *

UNITED STATES PATENT AND TRADEMARK OFFICE

CERTIFICATE OF CORRECTION

PATENT NO. : 5,522,678

DATED : June 4, 1996

INVENTOR(S) : Marshall et al

It is certified that error appears in the above-indentified patent and that said Letters Patent is hereby corrected as shown below:

On the title page: Item [73] Assignee's should read

-- North West Water Group PLC, Warrington, United Kingdom --.

Signed and Sealed this

Twenty-ninth Day of April, 1997

*Attest:*

*Attesting Officer*

BRUCE LEHMAN

*Commissioner of Patents and Trademarks*